US009299204B2

(12) United States Patent
Sendín Martín et al.

(10) Patent No.: US 9,299,204 B2
(45) Date of Patent: Mar. 29, 2016

(54) LOCKING SYSTEM WITH INFRARED COMMUNICATIONS

(75) Inventors: Ricardo Sendín Martín, Mendaro (ES); Sergio Pérez Urruticoechea, Bilbao (ES)

(73) Assignee: OJMAR, S.A., Elgoibar, Guipuzcoa (ES)

( * ) Notice: Subject to any disclaimer, the term of this patent is extended or adjusted under 35 U.S.C. 154(b) by 207 days.

(21) Appl. No.: 13/406,980

(22) Filed: Feb. 28, 2012

(65) Prior Publication Data

US 2012/0222461 A1 Sep. 6, 2012

(30) Foreign Application Priority Data

Mar. 3, 2011 (ES) ..... 201130283

(51) Int. Cl.
*G07C 9/00* (2006.01)

(52) U.S. Cl.
CPC ..... *G07C 9/00309* (2013.01); *G07C 9/00817* (2013.01); *G07C 2009/00785* (2013.01); *G07C 2009/00841* (2013.01); *G07C 2209/04* (2013.01); *G07C 2209/62* (2013.01); *Y10T 70/7062* (2013.01)

(58) Field of Classification Search
CPC ..... E05B 45/06; E05B 47/0001; B60R 25/04
USPC ..... 340/5.1, 3.1, 542, 5.6
See application file for complete search history.

(56) References Cited

U.S. PATENT DOCUMENTS 6,345,522 B1 * 2/2002 Stillwagon et al. ..... 70/277
6,876,293 B2 * 4/2005 Frolov et al. ..... 340/5.7
6,900,720 B2 * 5/2005 Denison et al. ..... 340/5.9
7,701,739 B2 * 4/2010 Mollo ..... 363/142
2010/0206023 A1 * 8/2010 Pollabauer ..... 70/275

FOREIGN PATENT DOCUMENTS

| | | | |
|---|---|---|---|
| ES | 245 544 | U | 1/1980 |
| ES | 1 006 008 | U | 12/1988 |
| ES | 2 104 976 | T3 | 10/1997 |
| ES | 2 134 140 | A1 | 9/1999 |
| ES | 1 047 775 | U | 5/2001 |
| ES | 2 183 739 | A1 | 3/2003 |
| ES | 2 310 451 | A1 | 1/2009 |
| ES | 1 072 762 | U | 9/2010 |

OTHER PUBLICATIONS

Spanish Search Report for corresponding Spanish Patent Application No. 201130283 mailed May 17, 2012.

* cited by examiner

*Primary Examiner* — Vernal Brown
(74) *Attorney, Agent, or Firm* — Merchant & Gould P.C.

(57) ABSTRACT

A locking system with infrared communications includes a lock (1) and a programming key (2). The lock (1) includes an interacting device (3) for interacting with the user, a first communications module (4) having an infrared sensor which receives and sends information when communications with the key (2) is established. A first control module (5) manages the received information and a mechanical device (6) opens and locks the locking system a first warning (7) and a first power supply (8). The programming key (2) includes a second communications module (10) including an infrared sensor for communicating with the lock (1), a second control module (11), a storage module (12), a second warning (13), a connector for connection externally (14) and a second power supply (15).

8 Claims, 1 Drawing Sheet

LOCKING SYSTEM WITH INFRARED COMMUNICATIONS

This application claims benefit of Serial No. 201130283, filed 3 Mar. 2011 in Spain and which application is incorporated herein by reference. To the extent appropriate, a claim of priority is made to the above disclosed application.

FIELD OF THE INVENTION

The present invention is encompassed within the field of electronic locks, and more specifically, of infrared-communicated electronic locks.

BACKGROUND OF THE INVENTION

The already known locks which can be operated without contact have electromagnetic limitations when integrating them on metal doors and when using wireless communications.

Locks with pin connections in turn have the drawback that they leave said pins exposed to the elements and allow the entrance of water, dust and other substances into the lock which could leave it inoperable.

SUMMARY OF THE INVENTION

This invention presents a solution to the problem caused by pin connections.

Furthermore, infrared connection allows opening and locking without contact reducing vandalism because neither slits nor holes are exposed to the users inciting them to force the lock by introducing elements therein (keys, tools, chewing gums . . . ).

The present invention comprises an electronic lock and a programming key which communicated through a wireless infrared connection by means of which the operation of the lock is electronically controlled.

The lock comprises interacting means for interacting with the user for turning on the lock, opening and locking thereof by the user, a first communications module for receiving and emitting electronic data and a first control module which, depending on the received information, will proceed to send data from the lock to the programming key or activate some of the means comprised in the lock to perform the task sent by the programming key.

Once the user turns on the lock through the interacting means the first control module waits to receive data, either through the interacting means or through the infrared connection established by the first communications module with the programming key. In order to establish said communications, the first communications module will comprise an infrared sensor which will allow it to both receive and send the electronic data.

The data received by the first communications module is sent to the first control module so that it acts according to the received information. The first control module will activate the means necessary to carry out the function associated with the information sent by the programming key.

Said means will comprise mechanical means responsible for opening and locking the locking system itself and, preferably, first warning means which will indicate the task being performed by the lock to the outside at all times. The warning means will preferably comprise light emitting diodes or LEDs.

The first control module will comprise a storage unit for storing both the information received by the first communications module and the intermediate results or parameters of the tasks performed by the first control module.

The lock will additionally comprise first power supply means for powering the interacting means, the first communications module, the first control module and the first warning means.

The programming key comprises a second communications module for communicating with the lock, a storage module which will store the information received from the outside both through connecting means for connection with the outside and through the second communications module. Likewise, it will preferably comprise a second control module which will manage the information stored in the storage module and the information received by the second communications module, second warning means which will indicate the operation being performed by the programming key to the outside and second power supply means for powering the second communications module, the storage module, the second control module and the second warning means.

The second communications module comprises an infrared sensor configured for communicating with the lock by emitting and receiving electronic signals.

The connecting means for connection with the outside preferably comprise a USB (Universal Serial Bus) serial port through which the programming key would be connected to a computer in which the user would proceed to programme it.

The second warning means of the programming key will preferably comprise light emitting diodes or LEDs.

The locking system allows collecting events which occurred in the lock, the deletion of the lock, the reprogramming or resetting thereof and the changing the code by default in fixed locks.

The aforementioned operating modes are started, both in the key and in the lock, by sending a command referring to the start of the connection from the corresponding communications module to the corresponding control module. The start of a connection is associated with the activation of the corresponding warning means by the corresponding control module, which will indicate the tasks being performed by both the key and the lock at all times.

The warning means will allow the user to know the start of the connection set up, the end of the connection set up, information transmission and lastly, the end of information transmission through different sequences of turning on the LEDs.

The programming key will additionally turn on a red LED to indicate a lack of supply when it has been detected that an error has occurred or when the second power supply means notify that a pre-established consumption threshold has been exceeded.

Information transmission comprises sending the events information, stored previously in the storage unit of the lock, through the first communications module of the lock during events collection. This information is transmitted to the second control module which stores it in the storage module of the programming key once said information is received by the second communications module of the programming key.

Information transmission is performed from the programming key during lock deletion. The first communications module of the lock receives the deletion command and transmits it to the first control module so that it proceeds to delete the corresponding information from the storage unit of the lock.

Information transmission is performed from the programming key during reprogramming or resetting the lock. The first communications module of the lock receives the reprogramming or resetting data (for example, the installation no., the lock no., the date and the time, etc.) and transmits them to the first control module of the lock which proceeds to reset the lock with the new received data.

Information transmission is performed from the programming key during the change of code in fixed locks. The first communications module of the lock receives the new code and transmits it to the first control module which proceeds to reset the lock with this new code.

The programming key can act as a master key and a service key. The master key allows opening any lock, thus allowing it to be free so that it can be used by any user. The service key allows opening any lock and subsequently locking it leaving it with the same code which it had before opening. It thus allows checking the contents of the locker and locking it again leaving it locked with the same code.

The programming key also comprises an operating mode for disabled people. This operating mode allows opening and locking the locking system without having to input commands through the interacting means of the lock. In this mode, once the lock is turned on, the opening and locking information can be directly sent from the programming key through its communications module. The first communications module of the lock transmits the opening or locking command to the first control module so that it proceeds to perform said action.

BRIEF DESCRIPTION OF THE DRAWINGS

A set of drawings which aids to better understand the invention and which relates specifically to an embodiment of said invention, depicted as a non-limiting example thereof, will be described briefly below.

DETAILED DESCRIPTION OF AN EMBODIMENT

Figure 1:
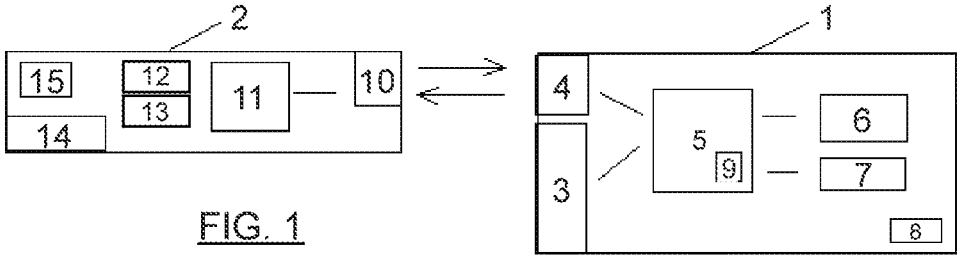
FIG. 1 shows the elements of the lock and the programming key.
Figure 2:
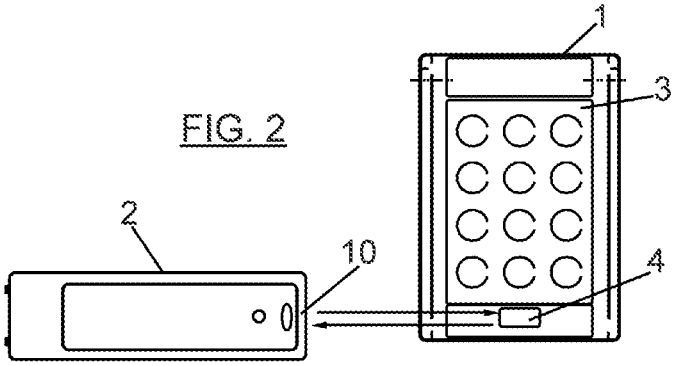
FIG. 2 shows a schematic view of the outer appearance of the lock and the programming key.
Figure 3:
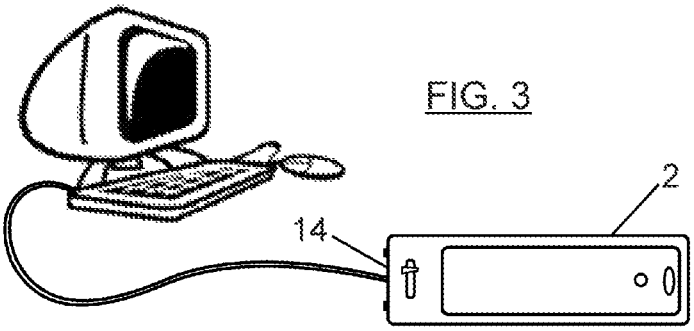
FIG. 3 schematically shows the connection of the key with a computer.

The locking system with infrared communications comprises:

a lock 1 which in turn comprises:

interacting means 3 transferring the information introduced by the user to a control module 5;

a first communications module 4 comprising an infrared sensor, said sensor being configured to receive information from the programming key and send information when communication with the programming key 2 is established;

a first control module 5 managing the information received by the interacting means 3 and by the communications module 4;

mechanical means 6 activated by the control module 5 and responsible for opening and locking the locking system;

first power supply means 8 powering the interacting means 3, the first communications module 4 and the first control module 5.

a programming key 2 which in turn comprises:

a second communications module 10 comprising an infrared sensor said sensor being configured to receive information from the lock and send the information stored in a storage module 12 when communication is established between the programming key 2 and the lock 1;

a second control module 11 managing the information received by the communications module 10;

the storage module 12 storing the information received by the communications module 10 and by connecting means for connection with the outside 14;

the connecting means for connection with the outside 14 allowing the exchange of information with the outside;

second power supply means 15 powering the second communications module 10, the second control module 11, the storage module 12 and the connecting means for connection with the outside 14.

The lock 1 will preferably comprise first warning means 7 which will be activated by the first control module 5 and which will indicate the function performed by the lock 1 to the outside at all times.

The programming key 2 will preferably comprise second warning means 13 which will be activated by the second control module 11 and which will indicate the function performed by the programming key 2 to the outside at all times. In this case the second warning means 13 will preferably comprise a plurality of light emitting diodes.

The first interacting means 3 will preferably comprise a keyboard.

The first control module 5 will preferably comprise a storage unit 9 configured for storing results of the control module 5 itself and the information received by the communications module 4.

The connecting means for connection with the outside 14 of the programming key 2 will preferably comprise a USB type serial port.

Having clearly described the invention, it is understood that the specific embodiments described above are susceptible to detail modifications provided that the fundamental principle and the essence of the invention are not altered.

The invention claimed is:

1. A locking system with infrared communications comprising:

an electronic lock comprising:

interacting means for turning on the lock and transferring information introduced by a user to a first control module, said interacting means comprising an externally accessible keyboard;

a first communications module comprising a first infrared sensor, said first infrared sensor being configured to receive information from a programming key and send information when communication with the programming key is established;

a first control module, comprising a storage unit configured for storing results or parameters of tasks performed by the first control module and the information received by the first communications module; wherein once the user turns on the lock through the interacting means, the first control module waits to receive data through the interacting means or through an infrared connection established by the first communications module with a programming key and manages said information received by the interacting means and by the first communications module;

mechanical means activated by the first control module for opening and locking the lock;

first warning means comprising a plurality of light emitting diodes which are activated by the first control module and which continuously externally display a function performed by the lock;

a first power supply for powering the interacting means, the first communications module, the first control module and the first warning means;

the programming key comprising:

a second communications module comprising a second infrared sensor, said second infrared sensor being configured to receive information from the lock and send information stored in a storage module when communication is established between the programming key and the lock;

a second control module managing the information received by the second communications module;

the storage module storing the information received by the second communications module and by connecting means for connecting externally;

the connecting means for connecting externally allowing exchange of information externally;

second warning means comprising a plurality of light emitting diodes activated by the second control module, the light emitting diodes forming a continuous external display of a function performed by the programming key;

a second power supply for powering the second communications module, the second control module, the storage module and the connecting means for connecting externally;

wherein the locking system has different operating modes which are started, both in the key and in the lock, by sending a command referring to a start of a connection from a corresponding communications module to a corresponding control module, the start of a connection being associated with activation of corresponding warning means by the corresponding control module, wherein the warning means are configured to indicate start of the connection set up, end of the connection set up, information transmission and end of information transmission through different sequences of turning on the light emitting diodes;

the operating modes comprising:

collecting events which occurred in the lock, by which events information stored in the storage unit of the lock are send through the first communications module of the lock to the second control module which stores the events information in the storage module of the programming key once said information is received by the second communications module;

deletion of the lock, wherein the first communications module of the lock receives a deletion command from the programming key and transmits the deletion command to the first control module, the first control module deleting corresponding information from the storage unit of the lock;

reprogramming or resetting the lock, wherein the first communications module of the lock receives reprogramming or resetting data from the programming key and transmits the reprogramming or resetting data to the first control module of the lock, the first control module resetting the lock with the new received data; and changing the code by default in fixed locks, wherein the first communications module of the lock receives a new code from the programming key and transmits the new code to the first control module, the first control module resetting the lock with the new code.

2. The locking system with infrared communications according to claim 1, wherein the connecting means for connecting externally of the programming key comprise a USB type serial port.

3. The locking system with infrared communications according to claim 1, wherein the programming key comprises a master key mode configured for opening the lock.

4. The locking system with infrared communications according to claim 1, wherein the programming key comprises a service key mode configured for opening the lock with a code and subsequently locking the lock and maintaining the code.

5. The locking system with infrared communications according to claim 1, wherein the programming key comprises an accessible operating mode wherein the locking system is configured for sending opening and locking information directly from the programming key through the communications module.

6. The locking system with infrared communications according to claim 3, wherein the programming key comprises a service key mode configured for opening the lock with a code and subsequently locking the lock and maintaining the code.

7. The locking system with infrared communications according to claim 3, wherein the programming key comprises an accessible operating mode wherein the locking system is configured for sending opening and locking information directly from the programming key through the communications module.

8. The locking system with infrared communications according to claim 6, wherein the programming key comprises an accessible operating mode wherein the locking system is configured for sending opening and locking information directly from the programming key through the communications module.

* * * * *